US007748647B2

(12) United States Patent
Clerget et al.

(10) Patent No.: US 7,748,647 B2
(45) Date of Patent: Jul. 6, 2010

(54) SPRAYING DEVICE AND USE OF THIS DEVICE

(75) Inventors: Bernard Clerget, Haudivillers (FR); Jean-Pierre Songbe, Saint Pierre en Val (FR); Pierre Dumont, Monchy sur Eu (FR)

(73) Assignee: Rexam Dispensing Systems S.A.S. (FR)

( * ) Notice: Subject to any disclaimer, the term of this patent is extended or adjusted under 35 U.S.C. 154(b) by 359 days.

(21) Appl. No.: 11/775,431

(22) Filed: Jul. 10, 2007

(65) Prior Publication Data

US 2008/0006719 A1 Jan. 10, 2008

(30) Foreign Application Priority Data

Jul. 10, 2006 (FR) ..... 06 06259
Jan. 24, 2007 (FR) ..... 07 00485

(51) Int. Cl.
*B05B 7/32* (2006.01)
*B05B 1/14* (2006.01)
*B05B 1/00* (2006.01)

(52) U.S. Cl. ..... 239/337; 239/548; 239/557; 239/567; 239/596; 222/402.13

(58) Field of Classification Search ..... 239/337, 239/461, 468–470, 488, 490–495, 497, 533.13, 239/533.14, 548, 556–559, 567, 596; 222/394, 222/395, 402.1, 402.13
See application file for complete search history.

(56) References Cited

U.S. PATENT DOCUMENTS 5,868,003 A 2/1999 Simas et al. ..... 62/603
6,145,712 A 11/2000 Benoist ..... 222/402.1
6,732,943 B2 * 5/2004 Srinivasan ..... 239/1
2006/0213408 A1 9/2006 Christ ..... 111/200

FOREIGN PATENT DOCUMENTS

| | | |
|---|---|---|
| DE | 202 12 798 | 11/2002 |
| EP | 0 891 945 | 1/1999 |
| EP | 1 621 253 | 2/2006 |
| EP | 169 83 99 | 9/2006 |
| JP | 2002-186882 | 7/2002 |
| WO | WO 03/072261 | 9/2003 |

OTHER PUBLICATIONS

French Search Report, Mar. 6, 2007, 2 pages.

* cited by examiner

*Primary Examiner*—Darren W Gorman
(74) *Attorney, Agent, or Firm*—St. Onge Steward Johnston & Reene LLC

(57) ABSTRACT

Manual spraying device including a push-button that can be actuated manually, the push-button including a spray nozzle, the spray nozzle having an inner chamber adapted to receive a non-gaseous fluid product under pressure and delimited towards the outside by a perforated front wall, a reservoir for the fluid product to be sprayed, and a dispensing device that can be mechanically actuated by the push-button and adapted to transfer the fluid product from the reservoir to the inner chamber of the nozzle, the front wall having a plurality of calibrated holes, each having a diameter of between 1 and 100 μm, the diameter of each hole not differing from a mean of the diameters of the various holes by more than 20%.

30 Claims, 6 Drawing Sheets

SPRAYING DEVICE AND USE OF THIS DEVICE

CROSS-REFERENCE TO RELATED APPLICATIONS

The present application claims priority of French patent application No. 06 06259 filed on Jul. 10, 2006 and of French patent application No. 07 00485 filed on Jan. 24, 2007, the content of which is incorporated herein by reference.

FIELD OF THE INVENTION

The present invention relates to a spraying device and a use for this device.

BACKGROUND OF THE INVENTION

More particularly, the invention relates to a manual spraying device comprising:

- a push-button that can be actuated manually, said push-button comprising a spray nozzle, said spray nozzle having an inner chamber adapted to receive a non-gaseous fluid product under pressure and delimited towards the outside by a perforated front wall,
- a reservoir for the fluid product to be sprayed,
- and a dispensing device that can be mechanically actuated by the push-button and adapted to transfer the fluid product from the reservoir to the inner chamber of the nozzle.

Document U.S. Pat. No. 6,145,712 describes an example of such a spraying device, wherein the front face of the spray nozzle has a single central hole.

In spraying devices of this type, the spray nozzles, which are conventionally mounted on pumps or on spray valves, have the disadvantage of bringing about a large dispersion of the diameter of the droplets of the sprayed fluid product.

Indeed, in spray nozzles of a device of this type, the fluid product is split up into fine droplets by a dynamic phenomenon that is particularly difficult to control, generally consisting of creating a vortex inside the inner chamber of the nozzle and of splitting up the fluid product into fine droplets as it leaves at a very high velocity through the central hole.

As an example, it has been possible to measure that, for a spray nozzle of the aforementioned type, of which the inner chamber receives an alcoholic solution under a pressure of 5 bar from a manual pump or a valve, and for a central hole of the nozzle having a diameter of 0.3 mm, the sprayed product consists of droplets having diameters of between 5 μm and 300 μm.

This dispersion can prove to be undesirable when it is desired to spray droplets with substantially uniform sizes. For example, it may be desired to spray droplets with a small size for the inhalation of medicinal treatments of the bronchi, or furthermore, it may be desired to spray larger droplets for cosmetic or perfumery applications, so that the droplets penetrate as little as possible into the bronchi of the user.

Moreover, droplets with very different sizes also follow very different trajectories, which is harm for the controlled application of the sprayed product. For example, when spraying a perfume onto the skin of a user, droplets that are too large can fall on the clothes of the user instead of being projected onto the skin, with the risk of producing indelible spots.

SUMMARY OF THE INVENTION

The object of the present invention is in particular to overcome these disadvantages.

To this end, the invention provides a spraying device of the aforementioned type wherein the front wall has a plurality of calibrated holes, each having a diameter of between 1 and 100 μm, the diameter of each hole not differing by more than 20% from a mean of the diameters of the various holes.

It will be noted that the term "diameter" does not necessarily imply that this cross section is circular. Thus, the holes of the front face could, where appropriate, have a polygonal cross section, for example a square cross section, without departing from the scope of the present invention. In this case, the aforementioned diameter will be the equivalent diameter of the hole, namely the diameter of a circular hole having a cross section with the same area as the polygonal hole. If the holes do not have a constant cross section over their length, the diameter in question is the diameter of the minimum cross section of the holes.

By virtue of the arrangements described above, the size of the droplets sprayed by the spraying device are controlled and good uniformity of this size of the droplets is ensured.

In addition, the aforementioned devices also make it possible to be independent at least partially of the pressure differences with which the fluid product is fed into the inner chamber of the spray nozzle, since experiments have shown that the size of droplets obtained by means of the present invention depends very little on this pressure (the pressure differences in question can come for example from differences in the actuating force of a user if the fluid product is fed by means of a manual pump or furthermore, when the fluid product is fed by means of a valve from a reservoir of the product under pressure, the pressure differences in question can come from the fact that the reservoir has already been partially emptied by previous uses of the spraying device).

In addition, the invention aims to improve control over the shape of the aerosol obtained leaving the spray nozzle while enabling the calibrated holes to be made simply.

To this end, in an embodiment that is complementary to, or independent of the embodiment previously defined, the front wall can be elastically deformable between a rest state, in which said front wall is flat, and an actuating state when the fluid product under pressure is transferred into the inner chamber, in which said front wall has an outwardly directed convexity.

Thus, in the rest state, the holes can be made in a simple manner in the flat front wall, it being possible for each hole to have an axis that extends in a plane parallel to a central axis perpendicular to the front wall. In the actuating state, when the fluid product is sprayed, the axes of the holes move way from the central axis so as to have an outwards divergence and the fluid product can be sprayed in the form of an aerosol having a high cone angle.

In various embodiments of the spraying device according to the invention, it is moreover possible for one and/or another of the following devices to be made use of:

- the front wall in the actuating state has the form of a spherical cap,
- the front wall is secured to a peripheral side wall that extends longitudinally along a central axis substantially perpendicular to said front wall,
- the front wall is formed in a single piece with the side wall, the side wall is formed in a single piece with the push-button and the front wall has a thickness of between 0.10 and 0.20 mm, the side wall is a part distinct from the push-button, secured to said push-button, and the front wall has a thickness of between 0.05 and 0.10 mm, the front wall is a part distinct from the side wall, secured to said side wall, the front wall is made of a material chosen from silicon, glass, metals and their alloys, ceramics and polymers, the side wall is made of a plastic and is overmoulded around the front wall, the front wall is made in the form of a complex including a least one polymer layer, the complex includes a polyester layer, the complex additionally includes a coating of self-adhesive material, the front wall being adhered to the side wall, the complex additionally includes at least one polymer layer chosen from polyethylene and polypropylene, the front wall being welded onto the side wall, the complex additionally includes at least one layer of metallic material, the complex has a thickness of between 0.025 and 0.120 mm, the diameter of each hole of the front wall dose not differ from said mean by more than 10%.

In addition, the invention aims to improve control over the distribution of droplets and the form of the aerosol.

To this end, independently of, or complementary to the embodiment previously defined, the holes of the front wall are distributed about a centre, each hole extends along an axis inclined with respect to the normal to said front wall in the region of said hole, said axis and said normal defining a plane substantially tangential to a circle centred on said central point and passing by the hole, the axes of all the holes having an inclination with respect to the corresponding normal, and said axes of all the holes being inclined in the same angular direction about said central point so as to generate a swirling aerosol when the fluid product is sprayed by said nozzle.

On account of the swirling trajectory of the droplets, the aerosol can have, in the vicinity of the spray nozzle, a substantially conical first part having a high cone angle and a second part substantially symmetrical with respect to the central axis of the nozzle.

In various embodiments of the spraying device according to the invention, it is possible in addition to resort to one and/or another of the following arrangements:

all the holes have the same inclination, all the holes have an inclination of between 10 and 60 degrees, each hole has a part of its length that has substantially constant cross section and a length of between 0.08 and 0.3 mm, the front wall of the nozzle has 10 to 1000 holes, the mean of the diameters of the holes is between 1 and 3 μm (this range of values is especially suitable for spraying a pharmaceutical product for treating the lungs), the mean of the diameters of the holes is between 3 and 10 μm (this range of values is especially suitable for spraying a pharmaceutical product for treating the trachea and bronchi), the mean of the diameters of the holes is between 10 and 60 μm (this range of values is especially suitable for spraying a pharmaceutical product for treating the nose, mouth and throat), the mean of the diameters of the holes is between 50 and 100 μm (this range of values is especially suitable for spraying a pharmaceutical product for treating the skin or for spraying make-up products), the mean of the diameters of the holes is between 15 and 60 μm (this range of values is especially suitable for spraying perfumery products), the mean of the diameters of the holes is between 20 and 70 μm (this range of values is especially suitable for spraying skin-care cosmetic products), the dispensing device is chosen from a manual pump and a valve, the reservoir is filled with a fluid product to be sprayed having a dynamic viscosity of less than 50 cps, the dispensing device is suitable for feeding the inner chamber of the nozzle with a fluid product to be sprayed under a pressure less than 7 bar.

In addition, the object of the invention is also a use for a spraying device as defined above, for spraying a non-gaseous fluid product.

In various embodiments of this use, it is possible in addition to resort to one and/or another of the following arrangements:

the fluid product has a dynamic viscosity of less than 50 cps at 20° C., the spraying device is used to spray at least one pharmaceutical product for treating the lungs, the mean of the diameters of the holes of the nozzle being between 1 and 3 μm, the spraying device is used to spray at least one pharmaceutical product for treating the trachea and/or the bronchi, the mean of the diameters of the holes of the nozzle being between 3 and 10 μm, the spraying device is used to spray at least one pharmaceutical product for treating the nose, mouth or throat, the mean of the diameters of the holes of the nozzle being between 10 and 60 μm, the spraying device is used to spray at least one pharmaceutical product for treating the skin, the mean of the diameters of the holes of the nozzle being between 50 and 100 μm, the spraying device is used to spray at least one perfumery product, the mean of the diameters of the holes of the nozzle being between 15 and 60 μm, the spraying device is used to spray at least one skin-care cosmetic product, the mean of the diameters of the holes of the nozzle being between 20 and 70 μm, the spraying device is used to spray at least one make-up product, the mean of the diameters of the holes of the nozzle being between 50 and 100 μm, the inner chamber of the nozzle is fed with a product to be sprayed under a pressure less than 7 bar.

Other features and advantages of the invention will become apparent during the following description of three of these embodiments, given by way of non-limiting examples, in relation to the appended drawings.

DETAILED DESCRIPTION OF THE INVENTION

In the various figures, the same references denote identical or similar elements.

Figure 1:
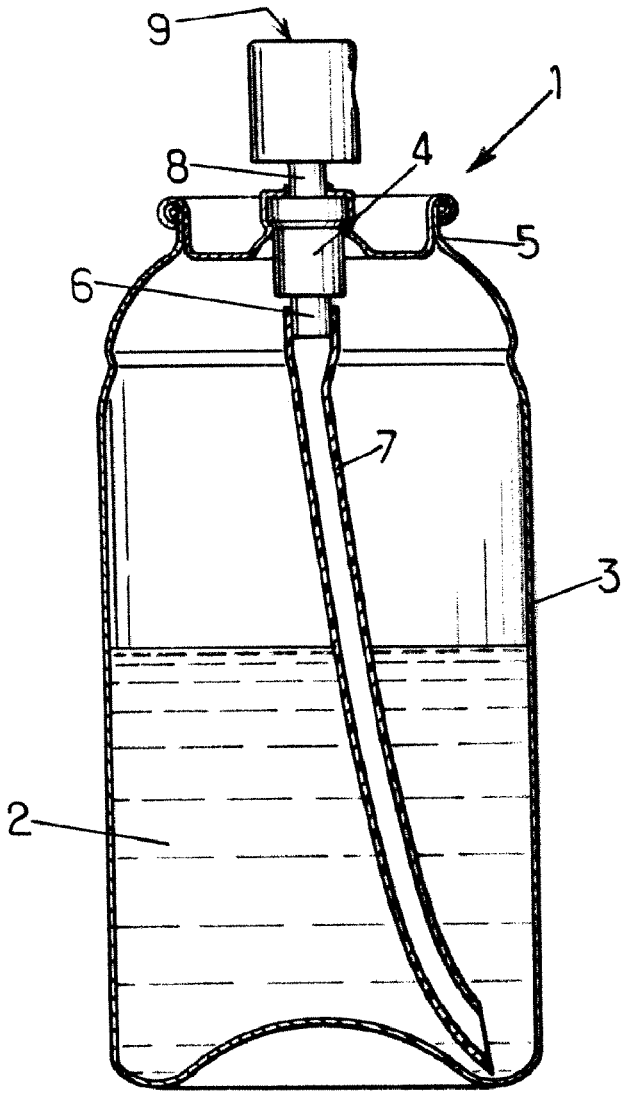
FIG. 1 is a view in vertical section of a spraying device for a fluid product according to one embodiment of the invention.

FIG. 1 shows a spraying device 1 suitable for spraying a non-gaseous fluid product 2 contained in a reservoir 3. The fluid product in question can be a liquid or semi-liquid product, for example a pharmaceutical product, a cosmetic product, a perfumery product or another product. The dynamic viscosity of the fluid product 2 is generally less than 50 cps (centipoise) at 20° C.

The spraying device 1 additionally includes a dispensing device 4 that is fixed in a known manner to a neck 5 of the reservoir 3 at the upper end of said reservoir.

The dispensing device 4 can for example be a manual spraying pump or furthermore a spraying valve, in which case the reservoir 3 is under pressure.

In all cases, the dispensing device 4 comprises a downwardly directed inlet 6 for the fluid product, which communicates with the bottom of the reservoir 3 via a dip tube 7, and a hollow actuating rod 8 which projects upwards. A push-button 9 is fitted to the upper end of the actuating rod 8, and serves both to actuate the dispensing device 4 and as an outlet for the sprayed fluid product, which outlet is made through the actuating rod 8 along the arrow 10 shown in FIG. 2.

It will be noted that the dispensing device shown in FIG. 1 could, as a variant, be used in the inverted position, that is to say the bottom of the reservoir 3 is directed upwards. In this case, the dispensing device 4 would not include the dip tube 7.

Figure 2:
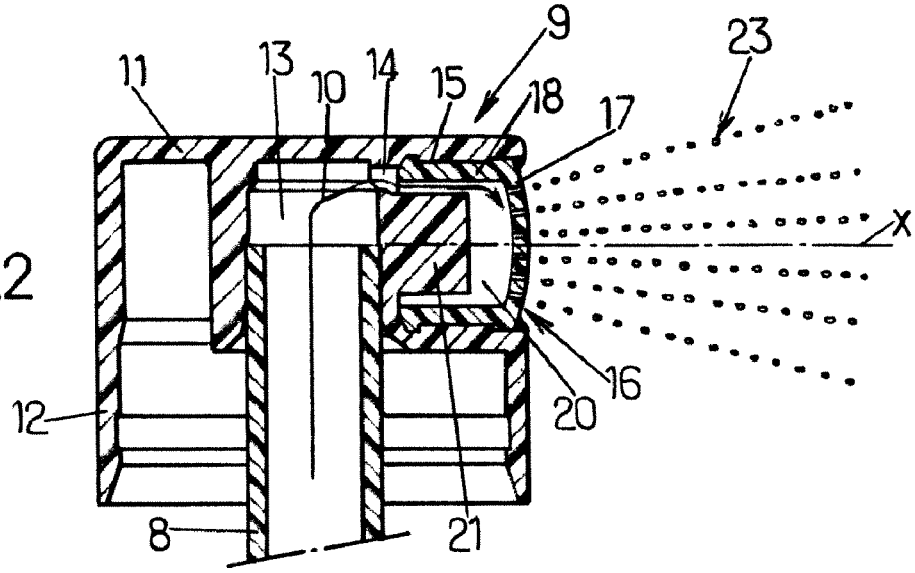
FIG. 2 is a view in vertical section of the push-button of the spraying device of FIG. 1, in a first embodiment of the invention.

As shown in FIG. 2, the push-button 9 can for example be moulded in a single piece of a plastic, in particular a polyolefin, for example in polypropylene or another plastic.

The push-button 9 comprises a substantially horizontal upper wall 11 and a substantially cylindrical and vertical skirt 12, which extends from the periphery of the upper wall 11.

In addition, the push-button 9 also includes a central well 13 that extends vertically downwards from the upper wall 11, to the centre of the side wall 12. The upper end of the actuating rod 8 is fitted into the central well 13.

A lateral passage 14 is provided at the upper end of the central well 13 and communicates with a housing for receiving the nozzle 15 of a substantially cylindrical shape, extending substantially horizontally along a central axis X and emerging towards the outside of the push-button 9.

Figure 3:
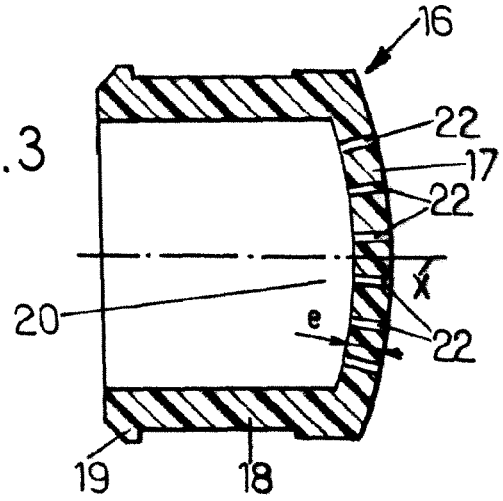
FIG. 3 is a detailed sectional view of the spray nozzle fitted to the push-button of FIG. 2, FIGS. 4 and 5 are views in vertical section of the push-button of the spraying device of FIG. 1, in a second embodiment of the invention, the figures showing the spray nozzle in a rest state and in an actuating state respectively.

As shown in FIGS. 2 and 3, a spray nozzle 16 is force-fitted into the nozzle housing 15. This spray nozzle 16 can be formed of a single piece made of plastic, for example of polybutylene terephthalate (PBT), of a cycloolefin copolymer (COC) or furthermore of a polyacetal (POM) and comprises:

- a perforated front wall 17; and
- an annular side wall 18 which has a cylindrical form (whether axisymmetric or not) which extends along the axis X inside the nozzle housing 15, from the periphery of the front wall 17.

In a known manner, the side wall 18 of the spray nozzle 16 can have, at its end opposite the front wall 17, an annular lip 19 which projects radially outwards and which penetrates the material of the push-button 9 in order to anchor the spray nozzle 16 into the nozzle housing 15.

The spray nozzle 16 delimits, with the push-button 9, an inner chamber 20 that communicates with the aforementioned passage 14 and that receives the fluid product to be sprayed when the dispensing device 4 is actuated. Possibly, as can be seen in FIG. 2, the push-button 9 can include a core 21 that projects towards the inside of the side wall 18 of the spray nozzle in order to limit the volume of this inner chamber 20.

As shown in greater detail in FIG. 3, the front wall 17 of the spray nozzle has a plurality of holes 22 that are distributed over the surface of said front face. The holes 22 can be from 10 to 1000 in number for example. The diameter of each hole 22 is generally between 1 and 100 μm, all the holes 22 being substantially of the same diameter.

More generally, the diameter of each hole 22 does not differ from the mean value of the diameters of the various holes 22 by more than 20% and advantageously, the diameter of each hole 22 does not differ from said mean value by more than 10%.

The holes 22 can be of a substantially cylindrical shape with circular cross section but they could, where appropriate, have a polygonal cross section, for example a square cross section, in which case the aforementioned diameter would be the equivalent diameter of the hole, namely the diameter of a circular hole having a cross section of the same area as the polygonal hole.

The diameter of the holes 22 can be chosen according to the fluid to be sprayed and for example:

- the mean diameter of the holes 22 can be between 1 and 3 μm (micrometers) for spraying pharmaceutical products for treating the lungs,
- the mean diameter of the holes 22 can be between 3 and 10 μm for spraying pharmaceutical products for the treatment of the trachea and bronchi,
- the mean diameter of the holes 22 can be between 10 and 60 μm for spraying pharmaceutical products for treating the nose, mouth and throat,
- the mean diameter of the holes 22 can be between 50 and 100 μm for spraying pharmaceutical products for treating the skin or for spraying make-up products,
- the mean diameter of the holes 22 can be between 15 and 60 μm for spraying perfumery products,
- the mean diameter of the holes 22 can be between 20 and 70 μm for spraying skin-care cosmetic product.

The front wall 17 can have a domed form with an inwardly directed concavity, as in the example shown in FIG. 3, but said front wall can be flat or have any other desired form.

In addition, the front wall 17 can have a thickness e generally between 0.08 and 1.5 mm, in particular between 0.2 and 0.4 mm.

The holes 22 can have a constant cross section, as in the example shown, but the holes 22 could, where appropriate, have parts flared inwards and/or outwards, in which case the length of the holes 22 to be taken into account would be the length in which these holes have a constant cross section and the diameter to be taken into account would be the diameter of the minimum cross section. The length of the holes 22, in their part with a constant cross section, generally is between 0.08 and 0.5 mm, advantageously between 0.08 and 0.3 mm and even more advantageously between 0.08 and 0.2 mm, in particular equal to approximately 0.1 mm.

As shown in FIG. 2, when a user presses the push-button 9, this actuates the dispensing device 4, which feeds the lower chamber 20 of the nozzle with the fluid product under pressure, at a pressure of generally less than 7 bar, for example around 5 bar. The fluid product is expelled through calibrated holes 22 of the front part 17, which produces an aerosol 23 of fine droplets with a relatively uniform size and that is only slightly dependent on the exact value of the pressure of the fluid product in the inner chamber 20.

Figure 4:
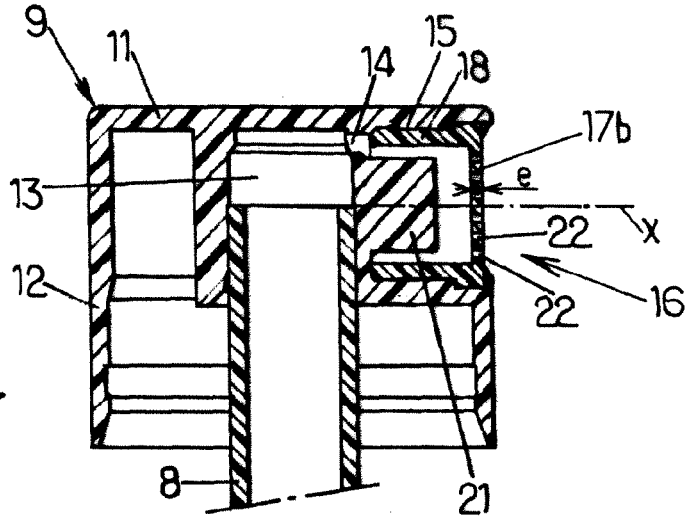
Figure 5:
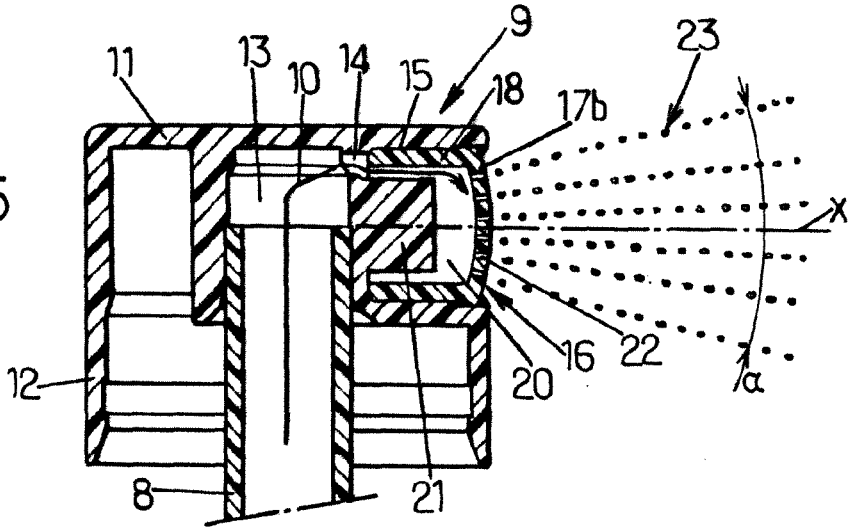

In the second embodiment shown in FIGS. 4 and 5, the spray nozzle 16 differs from the spray nozzle previously described in that the front wall 17*b* is elastically deformable between a rest state shown in FIG. 4 and an actuating state shown in FIG. 5, when the fluid product under pressure is transferred into the inner chamber 20.

In particular, in the rest state, the front wall 17*b* extends in a plane perpendicular to the central axis X. Also, in the actuating state, the front wall 17*b* has an outwardly directed convexity so that, for example, it has the form of a spherical cap.

As shown in FIGS. 4 and 5, in the rest state, the front wall 17*b* is flat. This arrangement makes it possible to produce the holes 22 in a simple manner having an axis that extends, for example, along a normal to the front wall 17*b*, parallel to the central axis X. When a user presses the push-button 9, the fluid product under pressure is transferred into the inner chamber 20, exerting a force on the front wall 17*b* so as to cause it to pass into the actuating state. The axes of the holes 22 diverge in relation to the central axis X so as to have an outwards divergence. The fluid product is expelled through the divergent holes 22 of the front wall 17*b*, which produces an aerosol 23 of fine droplets with a relatively uniform size, the aerosol 23 being substantially comical with a high cone angle $\alpha$.

In FIGS. 4 and 5, the side wall 18 is a part distinct from the push-button 9, secured to the push-button 9, and the front wall 17*b* consisting of a single piece with the side wall 18 is made of the same material as the side wall 18. In order to enable passage from the rest state to the actuating state, the front wall 17*b* may have a thickness e of between 0.05 and 0.10 mm.

The elastically deformable front wall 17*b* according to the second embodiment can be made complementary to or independent of the embodiment previously described in which all the holes 22 are substantially of the same diameter, between 1 and 100 μm, and the diameter of each hole 22 advantageously does not differ from the mean value of the diameters of the various holes 22 by more than 20%.

Figure 6:
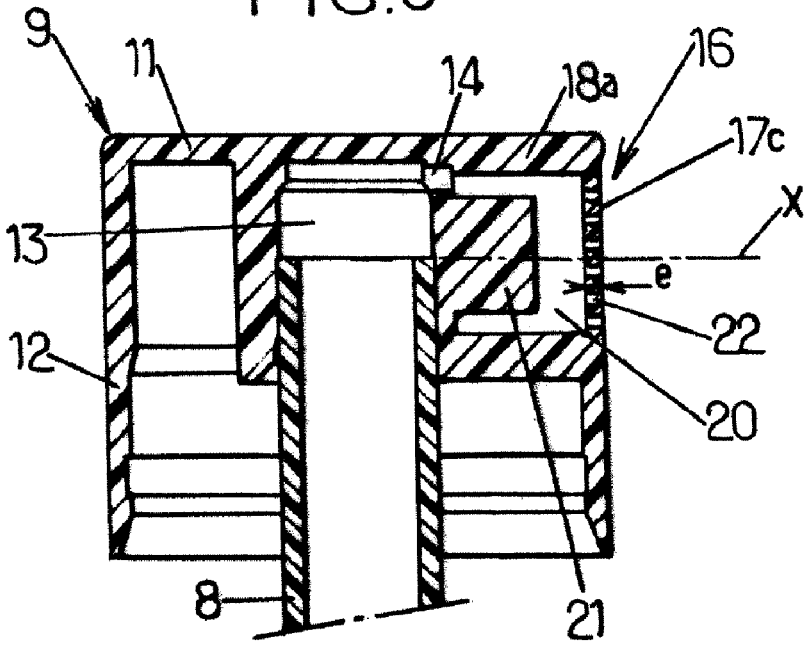
FIGS. 6 and 7 are similar views to FIGS. 4 and 5 respectively, in a variant of the second embodiment of the invention.
Figure 7:
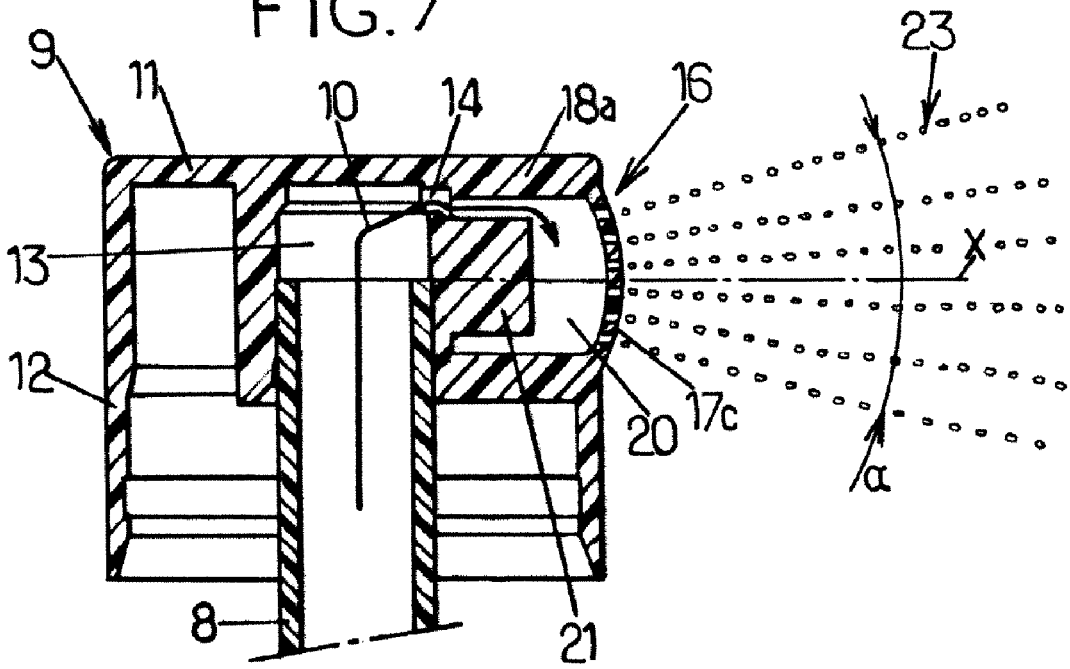

In the variant shown in FIGS. 6 and 7, it is possible to provide for the side wall 18*a* to be formed in a single piece with the push-button 9. The front wall 17*c* can therefore be made in a single piece with the push-button 9 and be of the same material as the push-button 9. The core 21 can then be an added part secured to the push-button 9 in a suitable manner.

As shown in FIGS. 6 and 7, it is possible to provide for the front wall 17*c* to be deformable. To this end, the front wall 17*c* can have a thickness of between 0.10 and 0.20 mm. It would be however possible to provide for the front wall 17*c* to have only a flat form, a rounded form or any other desired form.

Figure 8:
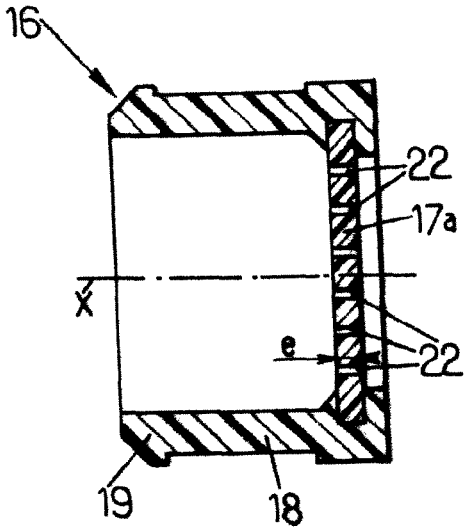
FIGS. 8 and 9 are similar views to FIGS. 2 and 3 respectively, in a variant of a third embodiment of the invention.
Figure 9:
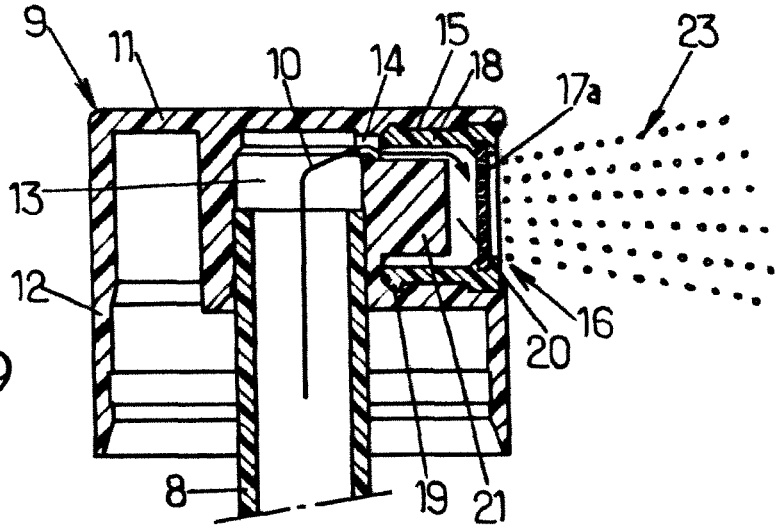

The third embodiment of FIGS. 8 and 9 is similar to the embodiment of FIGS. 2 and 3 and will therefore not be described once again in detail. In this embodiment of FIGS. 8 and 9, the spray nozzle 16 differs from the spray nozzle previously described by the fact that the front wall 17*a* is made of a material different from the front wall 18 of the nozzle, the side wall 18 being a part distinct from the push-button 9, secured to the push-button 9.

Figure 10:
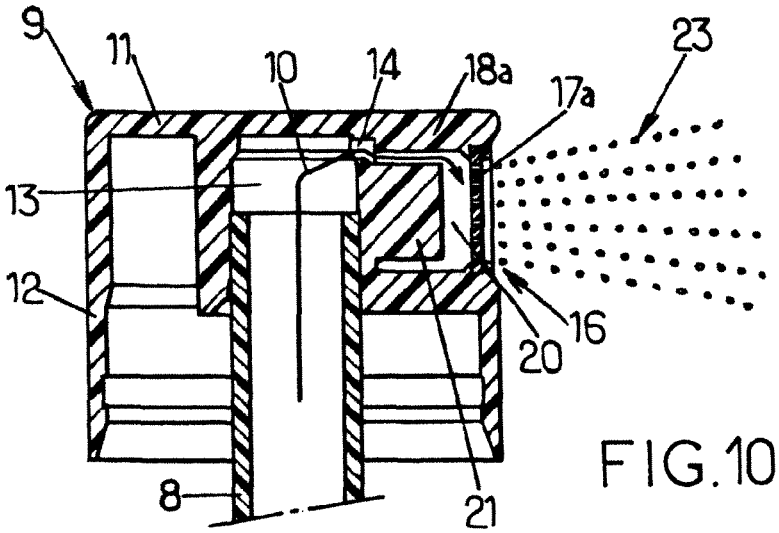
FIG. 10 is similar view to FIG. 9, in a variant of the third embodiment of the invention.

In a variant shown in FIG. 10, it is possible to provide for the front wall 17*a* to be secured to the side wall 18*a* formed in a single piece with the push-button 9.

For example, the front wall 17*a* can be made of a material chosen from silicon, glass, metals and their alloys, ceramics or polymers, while the side wall 18 is made of a plastic as in the previous example, it being possible that said side wall 18 to be overmoulded over the periphery of the front wall 17*a*.

In the embodiment of FIGS. 8 and 9, the front wall 17*a* is flat, but could be bowed as in the embodiment of FIGS. 2 and 3 or have any other form.

In addition, in another embodiment, the front wall 17*a* can be deformable. For example, the front wall 17*a* can be made in the form of a complex including at least one polymer layer and possibly a layer of metallic material. The complex can have a thickness of between 0.025 and 0.120 mm.

As non-limiting examples, the complex can comprise:

- a polyester layer, with a thickness of 0.025 mm and a self-adhesive coating making it possible to bond the front wall 17*a* onto the side wall 18, or
- a polyester layer with a thickness of 0.025 mm, a polyethylene layer, with a thickness of 0.020 mm, making it possible to weld the front wall 17*a* onto the side wall 18, or
- a polyester layer, with a thickness of 0.025 mm, and a polypropylene layer with a thickness of 0.020 mm, or
- a polyester layer, with a thickness of 0.025 mm, an aluminium layer, with a thickness of 0.008 mm, and a polyethylene layer, with a thickness of 0.040 mm.

Figure 11:
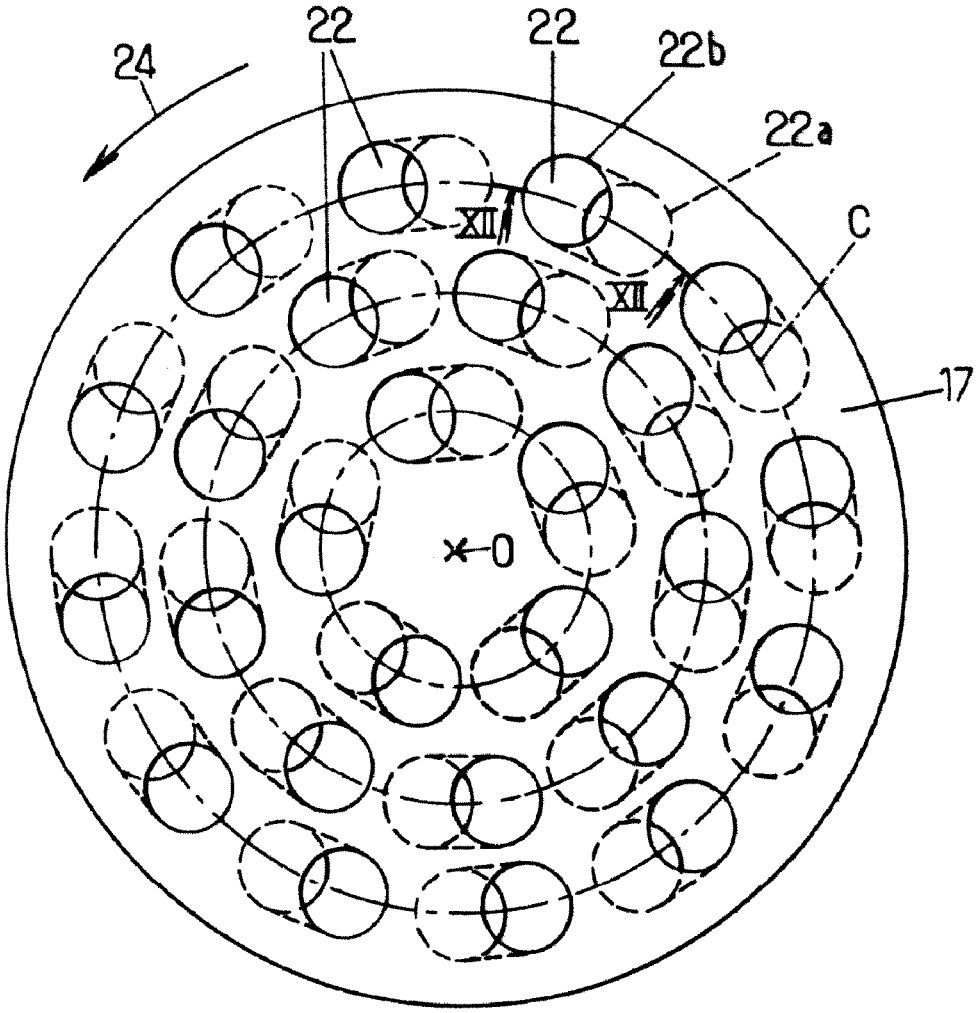
FIG. 11 is an elevation of the front wall of the spray nozzle of the device, in a fourth embodiment, the holes of this front wall being shown larger than they are in reality, for greater clarity.
Figure 12:
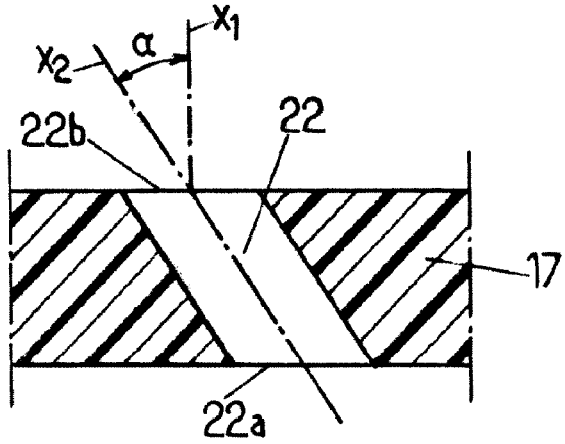
FIG. 12 is a developed sectional view along the curved line XII-XII of FIG. 11.
Figure 13:
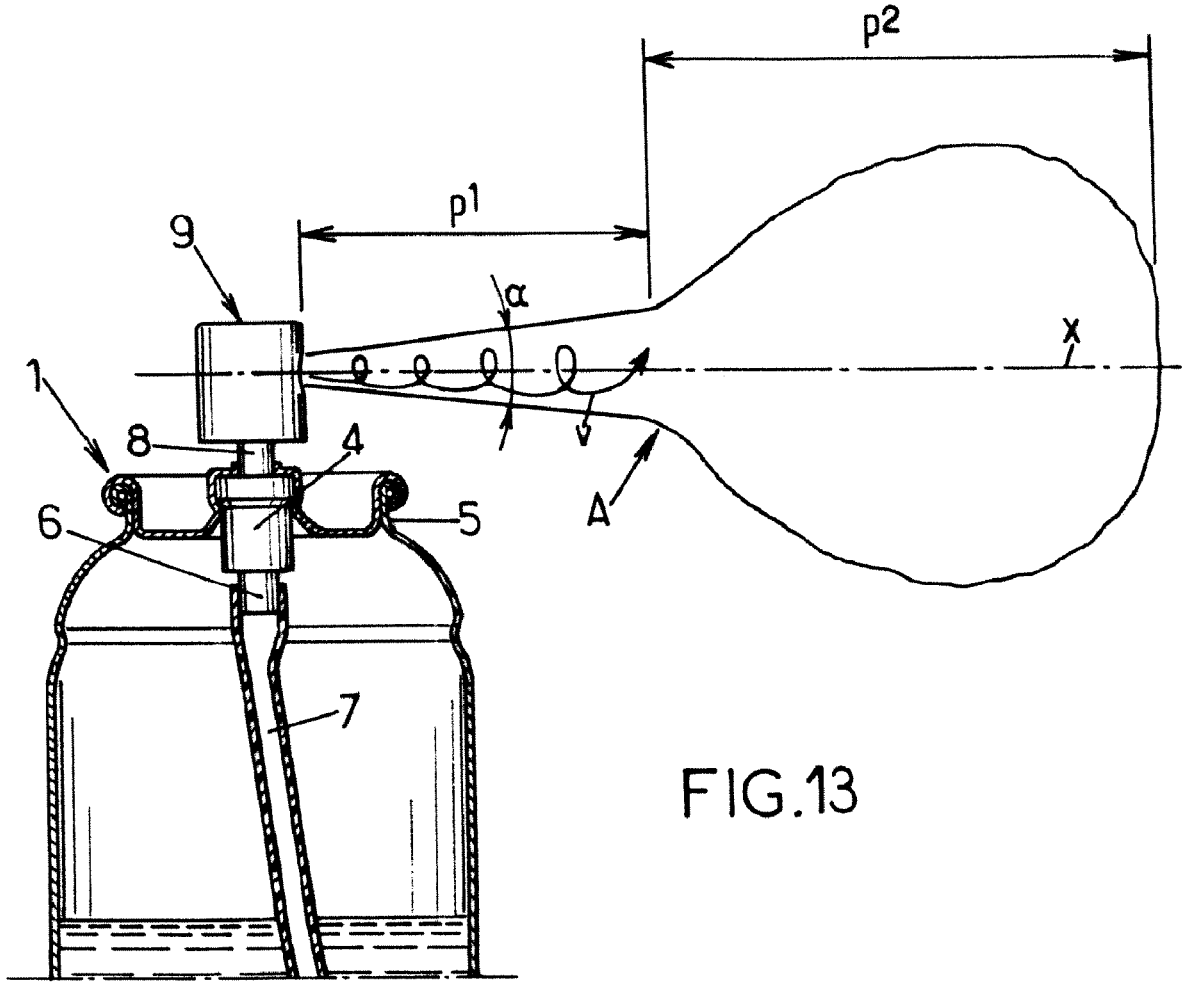
FIG. 13 is a similar view to FIG. 1, illustrating the operation of the fourth embodiment of the invention.

In the fourth embodiment of the invention, shown in FIGS. 11 to 13, complementary to or independent of the embodiment of the elastically deformable front wall 17, each hole 22 of the front wall 17 of the spray nozzle extends along an axis X2 inclined with respect to the normal X1 to said front wall in the region of said hole 22. The axis X2 and the normal X1 define a plane substantially tangential to a circle C centred on the central point of the front wall 17 and passing by the hole 22. The axes X2 of all the holes 22 have an inclination $\gamma$ in the same direction with respect to the corresponding normal X1. This inclination can advantageously be the same for all the holes, and is for instance between 10 and 60°, in particular of the order of 30°.

On account of the fact that the holes 22 are all inclined in the same angular direction 24 (FIG. 6), when an aerosol A is generated by the spray nozzle (see FIG. 8), the trajectory v followed by each droplet of the aerosol liquid is a swirling trajectory about the central axis X of the spray nozzle.

The aerosol A has a first part b1, in the vicinity of the spray nozzle, in which the liquid droplets are impelled forwards at a high velocity and which is substantially conical, having a relatively high cone angle $\alpha$ of the order of 20° or more.

Moreover, the aerosol A has a second part p2 forming a cloud in which the liquid droplets have a forward velocity less than in the first part p1. By virtue of the swirling movement of the liquid droplets, the second part b2 of the aerosol remains relatively symmetrical with respect to the axis X.

In this embodiment, with a front wall 17 having about a hundred holes 22 with a diameter of 3 μm provided in a wall 17 of thickness 0.3 mm, with an inclination of the holes of the order of 30° and with a pressure of an alcoholic liquid of the order of 0.5 bar inside the spray nozzle, spraying is obtained of an aerosol consisting of droplets with a diameter of 5 μm to 7 μm.

As a variant, it is possible to provide that the front wall 17 is elastically deformable. In the rest state, the calibrated holes 22 can then be made in a simple manner with an axis X2 that extends in a plane parallel to the central axis X as the spray nozzle 16. The divergence of the axis X2 of the calibrated holes 22 can be obtained when the push-button is actuated in order to increase the cone angle α of the first part of the aerosol A.

What is claimed is:

1. Manual spraying device comprising:

a push-button that can be actuated manually, said push-button comprising a peripheral side wall extend longitudinally along a central axis, and a spray nozzle, said side peripheral wall being integral with the push button and delimiting a housing for receiving the spray nozzle, said spray nozzle having an inner chamber adapted to receive a non-gaseous fluid product under pressure and delimited towards the outside by a perforated front wall, said front wall being flat and extending perpendicularly to the central axis, said front wall being part distinct from said peripheral side wall, directly secured to said peripheral side wall of the push-button;

a reservoir for the fluid product to be sprayed; and a dispensing device that can be mechanically actuated by the push-button and adapted to transfer the fluid product from the reservoir to the inner chamber of the spray nozzle;

characterized in that the front wall has a plurality of calibrated holes, each having a diameter of between 1 and 100 μm, the diameter of each hole not differing from a mean of the diameters of the various holes by more than 20%.

2. Spraying device according to claim 1, wherein the front wall is made of a material chosen from silicon, glass, metals and their alloys, ceramics and polymers.

3. Spraying device according to claim 1 , wherein the side wall is made of a plastic and is overmoulded around the front wall.

4. Spraying device according to claim 1, wherein the front wall is made in the form of a complex including at least one polymer layer.

5. Spraying device according to claim 4, wherein the complex includes a polyester layer.

6. Spraying device according to claim 5, wherein the complex additionally includes a coating of self-adhesive material, the front wall being adhered to the side wall.

7. Spraying device according to claim 5, wherein the complex additionally includes at least one polymer layer chosen from polyethylene and polypropylene, the front wall being welded onto the side wall.

8. Spraying device according to claim 4, wherein the complex additionally includes at least one layer of metallic material.

9. Spraying device according claim 1, wherein the diameter of each hole of the front wall does not differ from said mean by more than 10%.

10. Spraying device according to any claim 1, wherein each hole has a part of its length that has a substantially constant cross section and a length of between 0.08 and 0.3 mm.

11. Spraying device according to claim 1, wherein the front wall of the nozzle has 10 to 1000 holes.

12. Spraying device according to claim 1, wherein the mean of the diameters of the holes is between 1 and 3 μm.

13. Spraying device according to claim 1, wherein the mean of the diameters of the holes is between 3 and 10 μm.

14. Spraying device according to claim 1, wherein the mean of the diameters of the holes is between 10 and 60 μm.

15. Spraying device according to claim 1, wherein the mean of the diameters of the holes is between 50 and 100 μm.

16. Spraying device according to claim 1, wherein the mean of the diameters of the holes is between 15 and 60 μm.

17. Spraying device according to claim 1, wherein the mean of the diameters is between 20 and 70 μm.

18. Spraying device according to claim 1, wherein the dispensing device is chosen from a manual pump and a valve.

19. Spraying device according to claim 1, wherein the reservoir is filled with a fluid product to be sprayed having a dynamic viscosity of less than 50 cps.

20. Spraying device according to claim 1, wherein the dispensing device is adapted to feed the inner chamber of the nozzle with a fluid product to be sprayed under a pressure less than 7 bar.

21. Use of a spraying device according to claim 1 for spraying a non-gaseous fluid product.

22. Use according to claim 21, wherein the fluid product has a dynamic viscosity of less than 50 cps at 20° C.

23. Use according to claim 21 for spraying at least one pharmaceutical product for treating the lungs, the mean of the diameters of the holes of the nozzle being between 1 and 3 μm.

24. Use according to claim 21 for spraying at least one pharmaceutical product for treating the trachea and/or the bronchi, the mean of the diameters of the holes of the nozzle being between 3 and 10 μm.

25. Use according to claim 21 for spraying at least one pharmaceutical product for treating the nose, mouth or throat, the mean of the diameters of the holes of the nozzle being between 10 and 60 μm.

26. Use according to claim 21 for spraying at least one pharmaceutical product for treating the skin, the mean of the diameters of the holes of the nozzle being between 50 and 100 μm.

27. Use according to claim 21 for spraying at least one perfumery product, the mean of the diameters of the holes of the nozzle being between 15 and 60 μm.

28. Use according to claim 21 for spraying at least one skincare cosmetic product, the mean of the diameters of the holes of the nozzle being between 20 and 70 μm.

29. Use according to claim 21 for spraying at least one make-up product, the mean of the diameters of the holes of the nozzle being between 50 and 100 μm.

30. Use according to claim 21, wherein the inner chamber of the nozzle is fed with a product to be sprayed, at a pressure less than 7 bar.

* * * * *